US008833971B2

(12) United States Patent
Todd

(10) Patent No.: US 8,833,971 B2
(45) Date of Patent: Sep. 16, 2014

(54) SUBSURFACE ORGANIC LIGHT EMITTING DIODE DISPLAY

(75) Inventor: Eric Todd, Old Tappan, NJ (US)

(73) Assignee: BML Productions, Inc., Secaucus, NJ (US)

( * ) Notice: Subject to any disclaimer, the term of this patent is extended or adjusted under 35 U.S.C. 154(b) by 10 days.

(21) Appl. No.: 13/501,509

(22) PCT Filed: Oct. 12, 2010

(86) PCT No.: PCT/US2010/052369

§ 371 (c)(1),
(2), (4) Date: Apr. 12, 2012

(87) PCT Pub. No.: WO2011/046961

PCT Pub. Date: Apr. 21, 2011

(65) Prior Publication Data

US 2012/0201029 A1 Aug. 9, 2012

Related U.S. Application Data

(60) Provisional application No. 61/250,675, filed on Oct. 12, 2009.

(51) Int. Cl.

| | |
|---|---|
| ***F21S 4/00*** | (2006.01) |
| ***F21V 21/00*** | (2006.01) |
| ***F21S 8/00*** | (2006.01) |
| ***F21V 33/00*** | (2006.01) |
| ***A63C 19/10*** | (2006.01) |
| ***F25D 23/00*** | (2006.01) |
| ***E02D 17/00*** | (2006.01) |
| ***E02D 19/14*** | (2006.01) |
| ***H01J 1/62*** | (2006.01) |
| ***H01J 63/04*** | (2006.01) |
| ***G09G 3/14*** | (2006.01) |
| ***G09G 3/32*** | (2006.01) |
| ***G08B 5/22*** | (2006.01) |
| ***G09F 9/33*** | (2006.01) |
| ***G09F 19/22*** | (2006.01) |

(52) U.S. Cl.

CPC ..... *A63C 19/10* (2013.01); *G09F 19/228* (2013.01); *A63C 2203/14* (2013.01); *G09F 9/33* (2013.01)

USPC ..... 362/249.02; 362/145; 362/267; 362/234; 362/249.05; 62/235; 62/264; 405/217; 313/504; 313/512; 345/39; 345/82; 345/83; 340/815.45

(58) Field of Classification Search

CPC ... F21Y 2101/02; E01C 13/105; A63C 19/10; A63C 2203/14; G09F 19/00; G09F 23/00; G09F 23/02; G09F 23/04; F21S 8/022; F25C 3/02; F25D 27/00; F25D 17/042; F25D 2317/0417

USPC ..... 362/249.02, 145, 267, 234, 249.05, 362/394; 62/235, 264; 405/217; 313/512, 313/504; 345/39, 82, 83; 340/815.45

See application file for complete search history.

(56) References Cited

U.S. PATENT DOCUMENTS 2,457,619 A * 12/1948 Yocum ..... 62/235
2,587,855 A * 3/1952 Johnson ..... 62/66

(Continued)

FOREIGN PATENT DOCUMENTS

WO 2008012702 A1 1/2008

OTHER PUBLICATIONS

International Search Report, International Application No. PCT/US2010/052369 (mailed Dec. 14, 2010).

*Primary Examiner* — Ismael Negron
*Assistant Examiner* — William N Harris
(74) *Attorney, Agent, or Firm* — Weitzman Law Offices, LLC

(57) ABSTRACT

A display for an ice rink, comprising a first layer of ice within a peripheral boundary of the ice rink. An array of hermetically sealed, multiple individual organic light emitting diodes are positioned within the peripheral boundary on top of the first layer of ice. A second layer of ice on top of the array has an internal side facing the array and an external surface on a side opposite the internal side. A power source operatively connected to the array provides power to the individual organic light emitting diodes in the array. The multiple individual organic light emitting diodes are selectively controllable such that graphic images can be displayed by using specific organic light emitting diodes selected from among the individual organic light emitting diodes in the array and the graphic images will be visible through the external surface of the second layer of ice.

22 Claims, 3 Drawing Sheets

(56) References Cited

U.S. PATENT DOCUMENTS

| | | | | |
|---|---|---|---|---|
| 2,732,688 | A * | 1/1956 | Dickson | 62/235 |
| 4,667,481 | A | 5/1987 | Watanabe et al. | |
| 6,706,316 | B2 | 3/2004 | Ghosh et al. | |
| 7,202,602 | B2 | 4/2007 | Anandan | |
| 7,237,396 | B1 | 7/2007 | Nichol | |
| 7,775,674 | B1 * | 8/2010 | Ward | 362/153 |
| 2004/0119403 | A1 * | 6/2004 | McCormick et al. | 313/506 |
| 2005/0116667 | A1 | 6/2005 | Mueller et al. | |
| 2007/0053201 | A1 * | 3/2007 | Dietz et al. | 362/559 |
| 2008/0238305 | A1 | 10/2008 | Kondo et al. | |

* cited by examiner

SUBSURFACE ORGANIC LIGHT EMITTING DIODE DISPLAY

CROSS REFERENCE TO RELATED APPLICATION

This application claims benefit of U.S. Provisional Application No. 61/250,675, filed Oct. 12, 2009, the entirety of which is incorporated herein by reference.

BACKGROUND

1. Field of the Invention

This disclosure relates generally to light emitting diode displays, and, more particularly, to an organic light emitting diode ("OLED") display that may be used as a subsurface video and/or lighting display below ice in an ice skating rink and/or underwater.

2. Description of Related Art

Recreational sporting arenas utilize various forms of visual stimuli to entertain their patrons. For example, flashing scoreboards communicate event statistics to sports fans. Laser light displays and decorative lighting can add accent to action on the field, or provide a simple visual boost to the surroundings. Spotlights may be used to illuminate players, or draw the crowd's attention to a specific locale. Large visual displays may be used to showcase players and other participants in higher clarity than patrons would otherwise be able to see. Subsurface lighting is an attractive way to further enhance communication and entertainment for an arena audience, including advertisements and visual effects (e.g., simulating rippling water).

Subsurface lighting projects visual information directly beneath the surface of a transparent or translucent arena field (e.g., water). Lighting under an arena surface is advantageous because visual stimuli are conveyed directly from the center of attention in the arena and are generally visible to all patrons/attendees in the audience.

However, the actual implementation of a subsurface lighting display is challenging. Because of the logistics of arena seating, the display must transmit visual information evenly across a large viewing angle. Additionally, installation of a display within a body of water or ice presents new difficulties. For instance, placing a display within an ice layer complicates the process of forming the ice. Ice in an ice rink is typically only 0.75 to 1.5 inches thick, and positioned once a season in 1/32 inch layers. These layers must be laid down evenly as undulating variations in the surface of the ice are unacceptable. Most displays often require additional components (such as backlighting, inverters, power supplies, transformers, data converters, video display DVI devices, and other control and/or power related components), which serve only to increase their size and depth, and complicate the logistics of installing a subsurface display under a perfectly smooth ice surface, whether permanent or not. Displays also generate a substantial amount of heat, which, until now, has prevented their application under ice, as the temperature of the ice must be carefully monitored and maintained within a specifically narrow range.

BRIEF SUMMARY

In one aspect of this disclosure, an ice rink with an integrated, subsurface lighting and/or video display is disclosed. A hermetically sealed OLED display is positioned below the surface of at least one layer of ice. Power cabling is positioned below the at least one layer of ice and is operatively connected to the OLED display to supply power and video signal to the OLED display.

In another aspect of this disclosure, a method for installing a subsurface lighting and/or video display beneath the ice of an ice rink is disclosed. The method comprises hermetically sealing an OLED display to prevent water and ice intrusion. A solution of brine is chilled and pumped through a series of pipes at least partially underlying an intended surface area of the ice rink. The OLED display is positioned over at least part of the intended surface area of the ice rink and under at least one layer of ice. Power cabling is positioned below the at least one layer of ice and is operatively connected to the OLED display to supply power and video signal to the OLED display.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

BRIEF DESCRIPTION OF THE DRAWINGS

This disclosure is further described in the detailed description that follows, with reference to the drawings, in which.

DETAILED DESCRIPTION

This application discloses an ice rink with a preferred integrated, subsurface lighting and/or video display. In the preferred embodiment, the display is an OLED display. It is understood, however, that other types of displays (such as (but not limited to) LED display, photovoltaic device and/or any combination thereof) may be substituted for or utilized in combination with the preferred OLED display described below.

In one embodiment, the under ice lighting and/or video display is preferably hermetically sealed and positioned below the surface of at least one layer of ice. Cabling, preferably flat cabling, is positioned below the at least one layer of ice and is operatively connected to the display to supply power and video signal to the display. The display may be a temporary or permanent installation using connected modules/panels of LEDs or OLEDs to form a cohesive display area.

OLEDs have significant advantages over other forms of lighting for this type of application. OLEDs enable a great range of colors, brightness and viewing angles because OLED pixels directly emit light. OLED pixel colors appear correct and unshifted, even as the viewing angle approaches 90° from normal. The image projected will, therefore, be uniformly visible to patrons sitting in the stands. OLEDs do not require a backlight to function and may be printed onto any suitable substrate or carrier using, for example, an inkjet printer or screen-printing technologies. The OLEDs may be deposited in rows and columns onto a flat carrier or substrate resulting in a matrix of pixels capable of emitting light of different colors. OLED displays are also very thin compared to conventional video display screens, and may be as small as a few micrometers to a few millimeters in width. This enables an OLED display to fit underneath a thin ice layer without causing substantial variations in the surface of overlying ice, or causing issues with the formation of the ice.

Additionally, OLED displays may operate at lower voltages than other lighting devices, thereby generating less heat, which is critical for an application in or under ice. The use of LED or OLED displays allows the operator of the controls to regulate very specifically, the amount of time each pixel or section of the display is on, and to present non-static content that, while visually stimulating and conveying the desired image, contains sufficient movement of the images that the time each pixel or section of the display fluctuates so as to minimize heat buildup and avoid any adverse affect on the ice quality.

Figure 1:
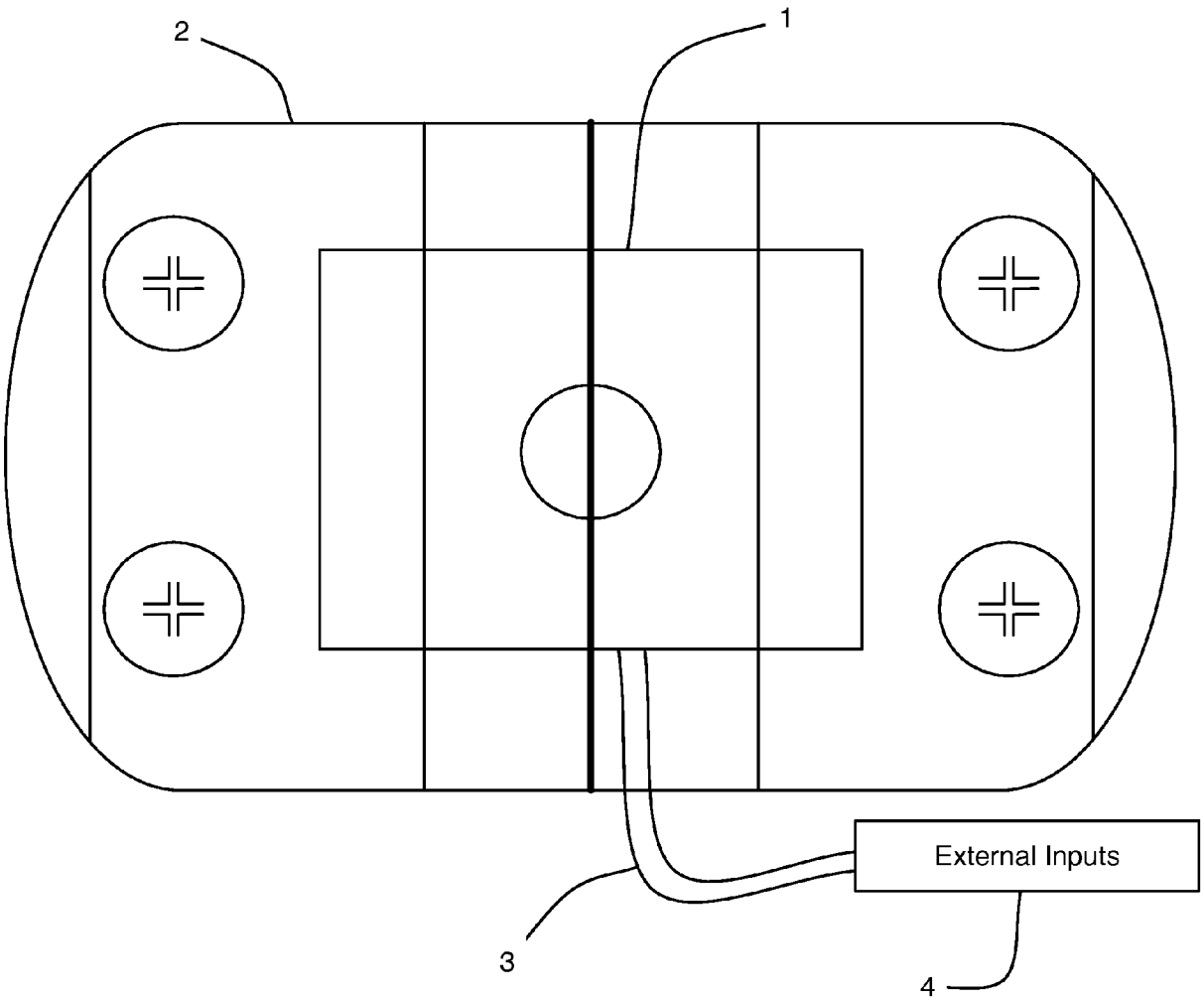
FIG. 1 illustrates an exemplary implementation of a subsurface OLED display installed in an ice rink.

FIG. 1 illustrates an exemplary implementation of a subsurface, under ice lighting and/or video display 1 installed in an ice rink. The display 1 is preferably installed (permanently or temporarily) beneath at least one layer of ice covering exemplary ice rink 2. For highest resolution, the display 1 may be positioned in proximity to the playing surface of the ice. When the display 1 is in use, an image and/or lighting may be displayed across the area of the display as shown in FIG. 1. As mentioned above, the display 1 is preferably formed using OLEDs, but may alternatively be formed using LEDs, photovoltaic devices, or any combination thereof. The display 1 may be a passive matrix display, an active matrix display, a polymer or flexible OLED display, or any other display adequate to the needs of the end-user. An active matrix display may be preferable as it has the desirable qualities of low power consumption and a sufficiently fast refresh rate for displaying high quality moving images.

The display 1 is preferably hermetically sealed (represented as 100*a* in FIG. 2) to prevent air and ice or water intrusion, which can cause degradation and resulting failure of the device. The display 1 may be hermetically sealed using an epoxy resin or other adhesive (with or without inorganic fillers and/or organic materials) to form a perimeter seal between the OLED substrate and cover after being cured by, for example, ultraviolet light. The OLED substrate and cover may be glass or any other suitable material. Alternatively, the display 1 may be hermetically sealed by metal welding or soldering the perimeter of the OLED substrate to the perimeter of the cover. Similarly, ultrasonic energy may be used to melt a sealing material between the OLED substrate and cover to create a hermetic seal when the sealing material solidifies and bonds to the OLED substrate and cover. It is important that temperature generated during the sealing process does not damage the materials (e.g., electrodes and organic layers) within the OLED display.

One or more intermediate encapsulation layers (represented by 106 in FIG. 2) may also be incorporated within the display 1 to form one or more thin film barriers to further protect the device from moisture and air. The intermediate encapsulation layer(s) may be deposited in a conventional manner to seal the device.

A desiccant, such as (but not limited to) silica gel, Drietrite® (W.A. Hammond Drierite Co. Ltd.), calcium oxide, barium oxide, metal oxides, alkaline earth metal oxides, sulfates, metal halides or perchlorates, may be used to maintain the low humidity levels required by OLED devices. The desiccant may, for example, be sprayed on or otherwise applied to an interior surface (e.g., inside cover) of the display 1.

Signal and power cabling 3 operatively connects the display 1 to external inputs 4, which supply display data and/or power to display 1. Cabling 3 is preferably flat, as to minimize surface variations in the level of ice. Alternatively, referring to FIG. 3, cabling 3 may be installed directly through the chilled concrete layer 205 (and possibly into adjoining retaining wall 203 or other layers of the rink) if a more permanent installation is desired. For temporary installations, "ribbon" type flat cabling may be employed to supply power and data from the display modules to the edge of the ice and to connect to appropriate power and control devices.

If wireless High-Definition Multimedia Interface (HDMI) or other wireless video data transmission is used, then cabling 3 need only be for supplying power to the display 1. Similarly, cabling 3 for power may not be necessary if inductive power ports having a base coil are permanently installed in the concrete layer 205. Current supplied to and flowing through the inductive power port's base coil generates a magnetic field, which, in turn, induces current flow in one or more nearby corresponding coils within the display 1 to supply power to the display device.

An operator of the display may utilize controls integrated into or operatively connected to the external inputs 4 (e.g., signal inputs) to control the presentation on the display 1. The display 1 is preferably adapted to display any type of image, including (but not limited to) monochrome, color, single images, moving images, video, etc. It should be understood that the display area is not limited to the exemplary configuration illustrated in FIG. 1. For instance, the display area may encompass the entire area of the ice. Conversely, the display area may be much smaller. Multiple displays may be utilized as well, covering portions of the ice for localized visual display. Multiple displays may be arranged in patterns or in a grid, and combine to form a full viewing surface. Furthermore, markings on the ice (such as (but not limited to) strips, lines, delineations and/or the exemplary ice hockey markings shown in FIG. 1) may be created using the display, rather than the traditional method of painting them onto the ice. This would enable, for example, rapid transition from one team to another or from one type of sport to another, without requiring a repaint of the arena.

The display 1 may also be used to highlight action on the ice or playing surface. For instance, the display 1 may be adapted to display a red light immediately under the location of a hockey puck, or the playing surface may turn red to increase the excitement of the crowd when a goal is scored, the game is over, or the game enters into overtime. The display 1 may also be adapted to selectively display advertisements or other media to the audience during intermissions or other breaks in the game.

The display 1 may also function in conjunction with a performer or other moving element equipped with a radio frequency (RF), ultraviolet (UV), infrared (IR) or other wavelength transmitter that permits the control system to create a pattern associated with the moving item that moves wherever the transmitter moves. For example, a skater wearing a transmitter may appear to be skating on a movable cloud or image displayed on the display 1 that is, for instance, just a few feet in diameter. As another example, the display 1 may display, for instance, a comet-like tail that appears to follow a hockey puck embedded with a transmitter as it moves along the ice. Similarly, the display 1 may make use of LED devices that are not normally visible to the human eye, for example, instead of using LED devices of a 3 color RGB (red-green-blue) system or the newer 4 color RGBY (red-green-blue-yellow), the system could optionally use LED devices of a wavelength that is not visible to the unaided human eye, for example ultraviolet (UV) or infrared (IR), whether alone or as part of an RGB-UV, RGBY-UV, RGB-IR, RGBY-IR or other configuration. With such a system, the invisible wavelength LED devices would not to distract skaters, but could be made visible in the ice to spectators (live or remotely) with proper camera or viewing equipment. This can be beneficial, for example, for use by telecasters that lack the equipment to track the puck directly, or to enhance the experience for spectators watching through enhanced glasses or binoculars that make use of "night vision" or other light amplifying technology or otherwise can convert the invisible wavelengths into visible light to thereby provide the comet-tail or other view without creating a distraction on the ice.

Figure 2:
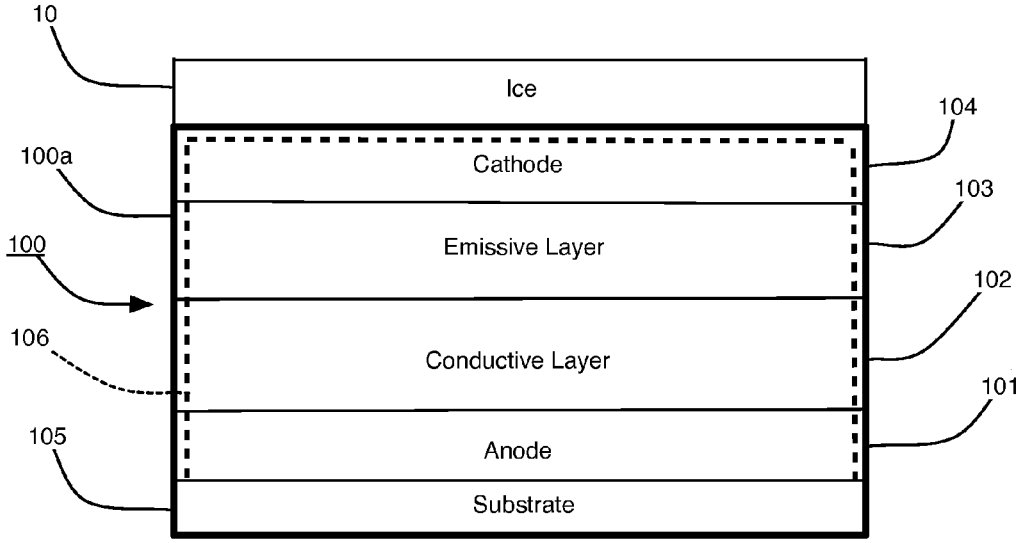
FIG. 2 is a cross sectional view of an exemplary subsurface OLED display installed under at least one layer of ice.

FIG. 2 illustrates a cross sectional view of an exemplary subsurface OLED display 100 installed under at least one layer of ice 10. The OLED display 100 may include at least an anode layer 101, a conductive layer 102, an emissive layer 103 and a cathode layer 104. When a voltage is applied across the OLED display 100, the anode layer 101 is positive with respect to the cathode layer 104 so that a current of electrons flow through the display 100 from the cathode layer 104 to the anode layer 101. The cathode layer 104, which is preferably transparent or semi-transparent, provides electrons to the emissive layer 104 and the anode layer 101 withdraws electrons from the conductive layer 102. Electrons from the emissive layer 103 and positively charged holes in the conductive layer 102 combine due to electrostatic forces, causing a drop in energy accompanied by an emission of visible light.

It is understood that multiple layers of OLEDs may be applied to or under the layer(s) of ice or playing surface in a stack or other configuration to create better color resolution in the display. Substrate 105 preferably supports the entire assembly, and may be made of a material with high thermal conductivity to minimize interference with ice formation. The anode layer 101 and cathode layer 104 may be arranged in strips as to form a passive-matrix OLED, with each pixel being formed by the intersection of an anode layer 101 strip with a cathode layer 104 strip. Alternatively, an active matrix OLED may be formed with a full cathode layer 104, and the anode layer 101 overlying a transistor film in a matrix pattern.

Figure 3:
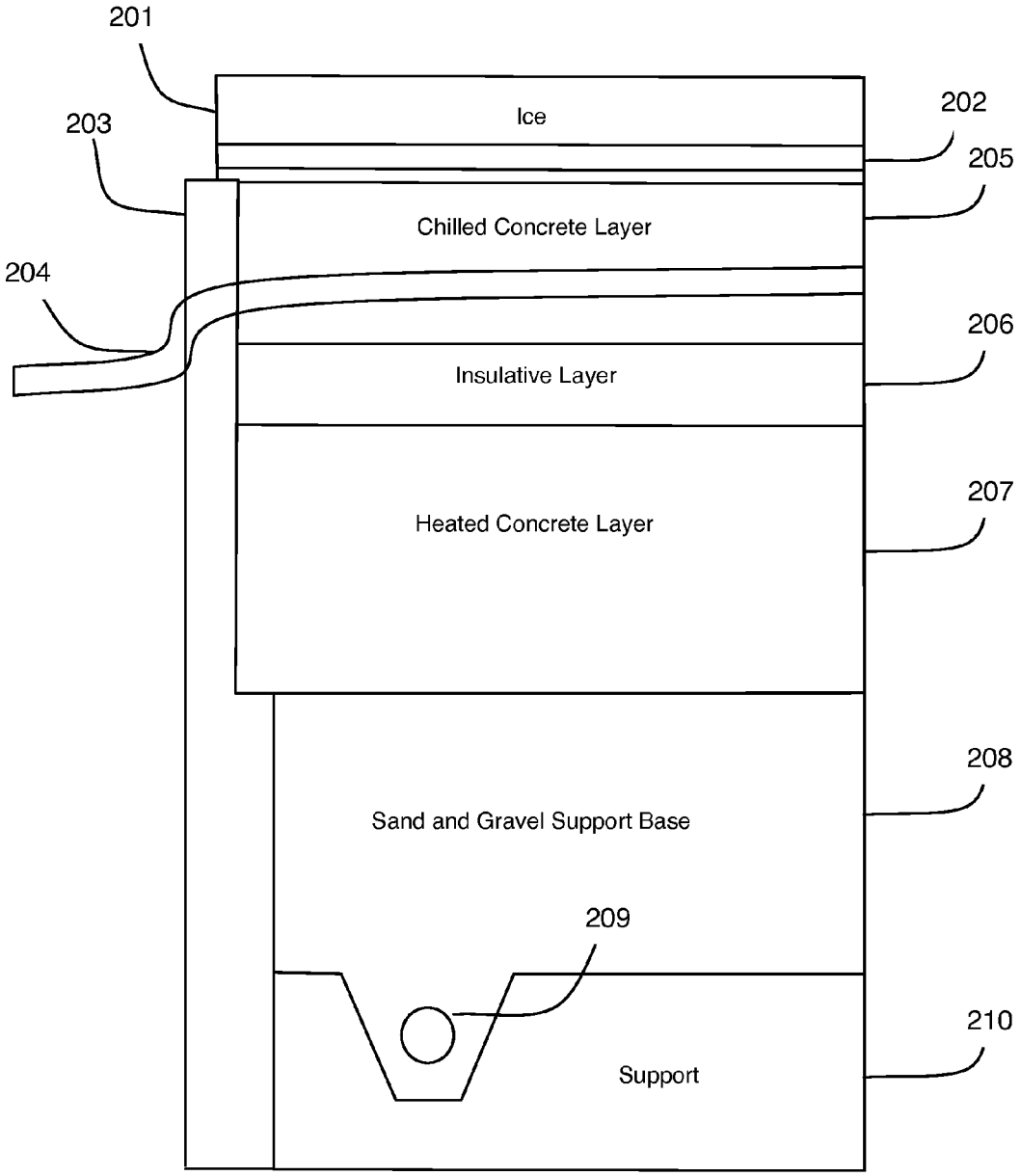
FIG. 3 is a cross-sectional view of an exemplary ice rink with an OLED display installed under at least one layer of ice.

FIG. 3 is a cross-sectional view of an exemplary ice rink with a display 202 installed under at least one layer of ice 201. As mentioned above, the display 202 is preferably hermetically sealed to prevent air and water or ice intrusion from interfering with the function of the display. The exemplary ice rink is preferably enclosed by retaining/supporting structure 203, which provides support and structure for the ice rink. The top layer may consist of ice layer 201, which itself may be composed of multiple sub-layers of ice. Typically, a base sub-layer of ice may be allowed to form first. A second layer may then be formed over the first and, for example, painted white if a white playing surface is desired. A third layer preferably seals the first and second layers of ice. A fourth layer of ice is used as a base for markings on the ice, such as lines for a field of play or team logos. Finally, 8-10 layers of ice may be formed, sealing the bottom layers and providing a surface for players to skate on.

The display 202 is preferably installed below at least one sub-layer of ice layer 201. The display 202 may be positioned under the initial sub-layer of ice. However, the display 202 may be positioned over any of the subsequent sub-layers, if so required by the needs of the end user. For highest resolution, the display 202 is preferably positioned closer to the playing surface of the ice. If the display 202 is positioned beneath a painted ice layer, a protective screen (e.g., contact paper) is preferably temporarily placed in the display area of the display 202 on top of the ice layer during painting to prevent the paint from obscuring the display 202.

A concrete layer 205 is preferably chilled to the appropriate temperature for ice formation by piping system 204, which provides channels for brine, alcohol/glycol antifreeze or the like (collectively referred to herein as "brine") as to flow through concrete layer 205. In the preferred embodiment, the brine may be chilled to approximately 16° F. (−9° C.), which in turn preferably maintains the chilled concrete layer 205 below 32° F. The display 202 preferably minimizes thermal interference between the chilled concrete layer 205 and ice layer 201 by way of a highly thermally conductive substrate 105 (FIG. 2). The brine itself preferably does not freeze because of its chemical composition. Layers of ice are preferably formed by flooding or misting the arena floor. Subsequently, the water is allowed to freeze into ice. Successive layers are subsequently formed by re-flooding or re-misting.

An insulative layer 206 underlies the chilled concrete layer 205, providing tolerance for expansion and shrinkage of the ice. Heated concrete layer 207 preferably keeps the underlying layers from freezing, which, if allowed, would cause the underlying layers to expand and crack the structure of the ice rink. Sand and gravel support base 208 preferably provide structural support to the entire structure, and may contain ground water drains 209. These drains 209 preferably empty into the support layer 210, which essentially may be the ground upon which the entire structure is built.

In addition to its use under ice, the hermetically sealed display disclosed herein has a multitude of other applications as well. The display may be used in other bodies of water, such as (but not limited to) landscape pools, swimming pools or other similar bodies of water. The display may also be used in exterior environments, such as gardens, houses, signboards, billboards, or even freestanding sculptures. The display may even be attached to a hot air balloon or low speed airplane for advertising purposes. Multiple displays can be arranged in tandem and their output may be coordinated to display larger or more complicated arrangements that comprise the full viewing area.

Having described and illustrated the principles of this application by reference to one or more preferred embodiments, it should be apparent that the preferred embodiment(s) may be modified in arrangement and detail without departing from the principles disclosed herein and that it is intended that the application be construed as including all such modifications and variations insofar as they come within the spirit and scope of the subject matter disclosed herein.

What is claimed is:

1. An ice rink display, comprising:

a first layer of ice within a peripheral boundary of the ice rink;

hermetically sealed, multiple individual organic light emitting diodes arranged in an array positioned within the peripheral boundary on top of the first layer of ice;

a second layer of ice within the peripheral boundary of the ice rink on top of the array, the second layer having an internal side facing the array and an external surface on a side opposite the internal side; and a power source operatively connected to the array for providing power to the individual organic light emitting diodes in the array;

wherein the multiple individual organic light emitting diodes are selectively controllable such that graphic images are displayed by using specific organic light emitting diodes selected from among the individual organic light emitting diodes in the array and the graphic images will be visible through the external surface of the second layer of ice.

2. The ice rink display of claim 1, wherein the hermetic seal comprises an epoxy resin.

3. The ice rink display of claim 1, wherein the hermetic seal comprises a welded metal perimeter about the array.

4. The ice rink display of claim 1, wherein the hermetic seal comprises an ultrasonically melted sealing material located between the array and a cover.

5. The ice rink display of claim 1, further comprising at least one intermediate encapsulation layer that forms a thin film barrier to separate the array from exposure to moisture and air.

6. The ice rink display of claim 1, further comprising a desiccant positioned relative to the array so as to maintain low humidity levels for the organic light emitting diode video display.

7. The ice rink display of claim 6, wherein the desiccant comprises at least one of: a silica gel, a calcium sulfate, a calcium oxide, a barium oxide, a metal oxide, an alkaline earth metal oxide, a sulfate, a metal halide, or a perchlorate.

8. The ice rink display of claim 1, further comprising a radio frequency receiver operatively connected to the array and configured to receive transmitted radio frequency signals that affect the graphic image to be displayed by the array.

9. The ice rink display of claim 1, wherein the multiple organic light emitting diodes comprise a stacked array.

10. A method of providing a display for an ice rink, comprising:

laying down a support layer of ice within the periphery of an ice rink;

installing a hermetically sealed organic light emitting diode array on top of the support layer of ice;

laying down a cover layer on top of the hermetically sealed organic light emitting diode array such that, when power is applied variably to illuminate individual organic light emitting diodes of the array, different graphical images will be formed by the illuminated individual organic light emitting diodes and the different graphical images will be visible through the cover layer.

11. The method of claim 10, further comprising configuring the array to wirelessly receive a signal that will affect display of a graphic image through the cover layer using the array.

12. The method of claim 10, further comprising hermetically sealing the organic light emitting diode array with epoxy resin.

13. The method of claim 10, further comprising hermetically sealing the organic light emitting diode array by metal welding a cover to a perimeter of the organic light emitting diode array.

14. The method of claim 10, further comprising hermetically sealing the organic light emitting diode array by ultrasonically melting a sealing material between the organic light emitting diode array and a cover.

15. The method of claim 10, further comprising adding at least one intermediate encapsulation layer to the organic light emitting diode array to form at least one thin film barrier for protecting the organic light emitting diode array from exposure to moisture and air.

16. The method of claim 10, further comprising using a desiccant to maintain low humidity levels for the organic light emitting diode video display.

17. The method of claim 10, further comprising forming the organic light emitting diode array by combining multiple sub-arrays of organic light emitting diodes so as to create an integrated video display.

18. The method of claim 10, further comprising highlighting an action taking place on the ice rink using different graphical images formed by the array.

19. The method of claim 10, further comprising displaying an advertisement through the cover layer using different graphical images formed by the array.

20. The method of claim 10, further comprising operatively connecting the organic light emitting diode array to a radio frequency transmitter that can transmit signals that affect a configuration of the graphical images displayed through the cover layer.

21. The ice rink display of claim 1, wherein the graphic images are video images.

22. The method of claim 10, wherein the graphic images are video images.

* * * * *